United States Patent [19]

Kramer et al.

[11] Patent Number: 4,817,300

[45] Date of Patent: Apr. 4, 1989

[54] APPARATUS FOR UNIFORMLY SUBJECTING A FLOW-TRAVERSABLE HEATABLE MATERIAL TO A FLUID FLOW

[75] Inventors: Carl Kramer; Reinhard Grundmann, both of Aachen, Fed. Rep. of Germany

[73] Assignee: Degussa Aktiengesellschaft, Frankfurt, Fed. Rep. of Germany

[21] Appl. No.: 142,788

[22] Filed: Jan. 11, 1988

[30] Foreign Application Priority Data

Jan. 23, 1987 [DE] Fed. Rep. of Germany ..... 3701995

[51] Int. Cl.[4] ..... F26B 21/06

[52] U.S. Cl. ..... 34/191; 34/38

[58] Field of Search ..... 34/191, 46, 38

[56] References Cited

U.S. PATENT DOCUMENTS

| | | | |
|---|---|---|---|
| 1,799,702 | 4/1931 | Puening | 34/191 |
| 1,919,646 | 7/1933 | Woolhouse | 34/191 |
| 2,347,601 | 4/1944 | Jackson | 34/191 |
| 3,065,553 | 11/1962 | Olin | 34/191 |
| 4,205,455 | 6/1980 | Kihlsledt | 34/191 X |

FOREIGN PATENT DOCUMENTS

| | | |
|---|---|---|
| 2600724 | 3/1977 | Fed. Rep. of Germany . |
| 2724021 | 12/1978 | Fed. Rep. of Germany . |
| 3248760 | 10/1984 | Fed. Rep. of Germany . |
| 3442907 | 6/1986 | Fed. Rep. of Germany . |

*Primary Examiner*—Steven E. Warner

*Attorney, Agent, or Firm*—Ratner & Prestia

[57] ABSTRACT

An apparatus for uniformly subjecting a flow-traversable heatable material, in particular a stack of plates, rods, tubes, pipes, or the like, to a fluid flow comprises a radial-flow fan which serves as flow drive and which is disposed above the plane of flaps which depending on the desired flow direction can be respectively opened or closed. The radial-flow fan comprises a spiral housing discharging on at least two sides, and the volume flow emerging from the discharge openings of said spiral housing is supplied alternately from the one side or from the other side to the heatable material simply by actuating the flaps.

3 Claims, 2 Drawing Sheets

APPARATUS FOR UNIFORMLY SUBJECTING A FLOW-TRAVERSABLE HEATABLE MATERIAL TO A FLUID FLOW

BACKGROUND OF THE INVENTION

1. Field of the Invention

The invention relates to an apparatus for uniformly subjecting a flow-traversable heatable material to a fluid flow.

The term "flow-traversable heatable material" applies in particular to stacks of plates, rods, tubes, pipes, etc., in which between the individual layers spacers are disposed to keep the individual layers a defined distance from each other.

2. Description of the Prior Art

The uniform heating of such a flow-traversable material is possible in many cases only by forced convection because upon radiation heating the heat transfer at the edge parts is substantially greater than at the centre region or core of the heated material. Since, however, frequently very long through-flow paths occur with convection heating, additionally the flow or stream must be reversed at adequately short intervals of time because with convection heat transfer the heat transfer conditions in a flow vary with the flow path, too.

Consequently, an arrangement must be provided which makes available the volume flow necessary for the flow passage together with the pressure necessary for overcoming the pressure loss and simultaneously permits a mirror inverted reverse of the flow, the so-called "reversing"; it must also be taken into account that said forcing pressure can be relatively high, in particular with relatively long flow paths as occur in plate stacks.

For this purpose, for example, in the drying technology, but also in industrial furnace construction, apparatuses are used in which the flow can be reversed by changing the direction of rotation of the fan. For this, only axial-flow fans are used because only this design permits a reversal of the flow direction on reversal of the direction of rotation.

Equal flow performances for both directions of rotation, however, are obtained only for straight blades and a 45° blade angle. In addition, guide wheels may not be used. Consequently, the pressure coefficient and the efficiency are very unfavourable. Admittedly, DE-PS No. 3,248,760 discloses an axial-flow fan in which the blades automatically adjust themselves in accordance with the direction of rotation; however, this solution cannot be used for high-temperature applications because of the hardly solvable bearing and strength problems.

Because such apparatuses are usually operated at relatively high temperatures the axial-flow fans are as a rule mounted in cantilever manner, i.e. in the vicinity of a wall, and consequently generally a deflection of the flow path is necessary. This function-induced design leads, however, necessarily to different behaviour of the axial-flow fan in its two directions of rotation and thus in the associated flow directions. Consequently, in practice an axial-flow fan used for recovering the flow always delivers a different volume flow in the one direction than the opposite direction, thus a correspondingly different flow through the heatable material also results.

Attempts have admittedly been made to compensate this asymmetry in that the axial-flow fan is driven for different lengths of time in the two directions of rotation. However, the results obtained with this solution are not satisfactory because with the volume flow the heat transfer situation also changes and the corresponding relationship is not linear, i.e. in this manner complete compensation cannot be achieved. Moreover, this leads to an unnecessary increase in the operating time and thus in the production costs.

Finally, a further great disadvantage of an axial-flow fan is that it has a very low pressure coefficient compared with corresponding radial-flow fans.

A further possibility of controlling and alos reversing the flow direction are flaps as disclosed for example in Germann Offenlegungsschriften Nos. 3,442,907, 2,724,021, 3,215,509 and 2,600,724. These flaps are usually pivoted flaps with hingelike mounting. As apparent with such flaps, for example, from Offenlegungsschrift No. 2,600,724 the flow, when the flap is arranged on the fan discharge side, can be deflected in different directions or alternatively with corresponding installation of the flaps in a flow duct a cross-section can be alternately opened or closed.

However, in conjunction with the flaps, advantageous as they are in themselves for flow control, the aforementioned known solutions use only low performance fans such as axial-flow fans (German Offenlegungsschrift No. 2,600,724) or simple radial-flow fans unsuitable for high-temperature use.

SUMMARY OF THE INVENTION

The invention is thus based on the problem of providing an apparatus for uniformly subjecting a flow-traversable heatable material to a fluid flow of the aforementioned type in which the aforementioned disadvantages do not occur.

In particular, an apparatus is proposed which permits in a constructionally simple manner the very uniform flow action on both sides of the heatable material for reversible flow direction and uses as flow drive a high-performance radial-flow fan.

The invention therefore proposes in an apparatus for uniformly subjecting a flow-traversable heatable material to a fluid flow comprising:

(a) a fan serving as flow drive and (b) in each case a flap closing or opening alternately in dependence upon the desired flow direction, the improvement that (c) a radial-flow fan installed above the plane of the flaps comprises a spiral housing blowing out on at least two sides and that (d) the volume flow emerging from the discharge openings of said spiral housing can be supplied to the heatable material from the one or from the other side simply by alternate actuation of the flaps.

Expedient embodiments are defined by the features of the subsidiary claims.

The advantages obtained with the invention are based on the use of a radial-flow fan which can be operated without any problem even at high temperatures and has relatively high pressure coefficients as necessary for a flow through stacks of heatable material or articles. The spiral housing contributes substantially to the desired obtaining of a high fan pressure and consequently optimum conditions are given for uniform heat transfer over the entire area of the heatable material.

Moreover, the radial-flow fan always operates in optimum manner, irrespective of the flow direction in the heatable material, and consequently the full pressure, which is relatively high with a radial-flow fan, is available for the flow through the heatable material.

The necessary flow reversal on the heatable material is thus not achieved by "switching" the flow drive, i.e. for example by changing the direction of rotation of an axial-flow fan, but simply by alternate opening and closing of two flaps, thereby achieving an exactly mirror inverted flow situation in the heatable material without the aforementioned disadvantages, unavoidable in hitherto known solutions, occurring.

BRIEF DESCRIPTION OF THE DRAWINGS

The invention will be explained hereinafter in detail with the aid of examples of embodiments with references to the attached schematic drawings, wherein.

DESCRIPTION OF THE PREFERRED EMBODIMENTS

Figure 1A:
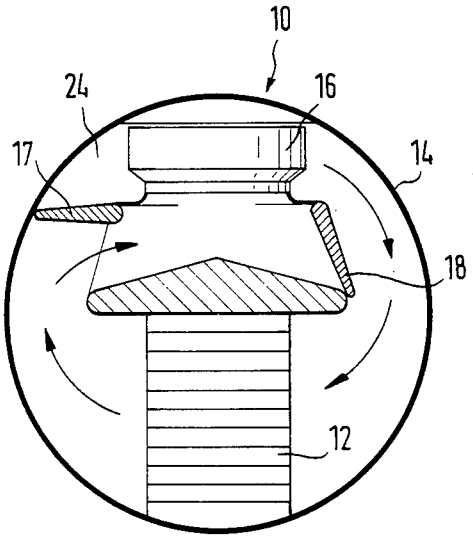
FIG. 1*a* is a first cross-section through a radial-flow fan with one opened and one closed flap.

The apparatus for uniformly subjecting a flow-traversable heatable material to a gas flow shown in the Figures and denoted generally by the reference numeral 10 is intended for use in a chamber furnace for heating a stack of material with regular openings as formed, for example, by plates, rods, tubes, pipes and similar elongated articles which are arranged on each other in individual layers; between the individual layers spacers are inserted so that intermediate spaces are formed through which the gas can freely flow.

The stack of heatable material is indicated in the Figures by the reference numeral 12.

Since the heat treatment must often take place at high temperatures and/or high partial vacuums or over pressures, the housing of the chamber furnace is constructed as cylindrical shell 14.

The flow drive is a radial-flow fan 16 which is installed at the top into the furnace housing with its axis vertical to the longitudinal axis of the cylinder of the cylinder shell 14 in such a manner that the radial-flow fan 16 is located vertically above the stack of material 12.

On each side of the cylindrical chamber housing 14 a flap 17, 18 is disposed with which the flow cross-section is alternately opened and closed. The flaps 17, 18 can be pivoted about axes which are parallel to the cylinder axis. The adjustment of the flaps 17, 18 is performed by turning their shafts from the outside by a drive means (not illustrated) which can be actuated via a corresponding open-loop or closed-loop control mechanism.

In the illustration of FIG. 1*a* the left flap 17 is closed and the right flap 18 is opened so that the stack of heatable material 12 is traversed by the flow from the right to the left as indicated by the corresponding flow arrows.

Figure 1B:
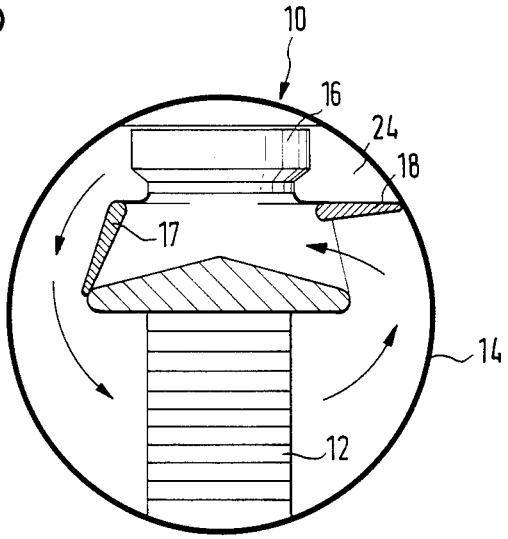
FIG. 1*b* is a further cross-section through the radial-flow fan, the respective other flap being opened or closed.

In the illustration of FIG. 1*b* the reverse flow situation is shown, i.e. the right flap 18 is open and the left flap 17 closed so that the stack of heatable material 12 is traversed by the flow from the left to the right.

Figure 2:
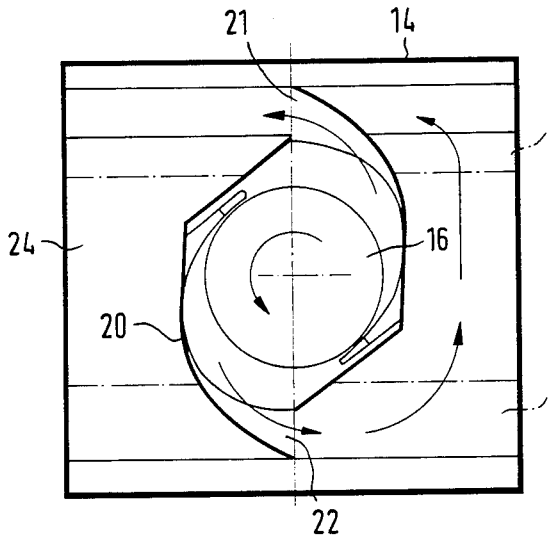
FIG. 2 is a horizontal section through the radial-flow fan.

The radial-flow fan 16 itself is incorporated into a spiral housing 20 (see FIG. 2) which has a plurality of discharge openings; in the embodiment illustrated two discharge openings 21, 22 are provided arranged mirror-like inverted. From said discharge openings 21, 22 the volume flow conveyed by the radial-flow fan 16 enters a distributing chamber 24 which is formed on the one hand by the separating wall in the plane of the flap axes, which also contains the suction opening of the radial-flow fan 16, and on the other hand by the circular cylindrical chamber wall. At its end sides said distributing chamber 24 also serving as blowout space is defined by circular segmental subareas of the circular cylindrical terminal walls of the cylindrical furnace chamber.

The spiral housing thus formed makes it possible to obtain the desired high fan pressures. Since in addition the radial-flow fan 16 can always operate in optimum manner irrespective of the flow direction in the stack of heatable material 12, in all operating states the full pressure, which is relatively high with a radial-flow fan 16, is available for flowing through the stack of heatable material 12. As explained above the flow reversal is effected by the simple alternate opening and closing of the two flaps 17, 18 so that an exactly mirror inverted flow situation is obtained in the stack of heatable material 12.

I claim:

1. An apparatus for uniformly subjecting a flow-traversable heatable material to a fluid flow comprising:

(a) a fan serving as flow drive;

(b) flaps closing or opening alternately in dependence upon the desired flow direction;

(c) a radial-flow fan installed above the plane of the flaps comprising a spiral housing blowing out on at least two sides;

(d) the volume flow emerging from the discharge openings of said spiral housing is adapted to be supplied to the heatable material from the one or from the other side simply by alternate actuation of the flaps; and (e) the installation space of the radial-flow fan above the flaps is a portion of a circular cylinder and has the cross-section of a circular segment.

2. An apparatus according to claim 1, wherein (f) a cylindrical chamber serves as housing, (g) the axes of the flaps being arranged parallel to the axis of said cylindrical chamber.

3. An apparatus according to claim 1, wherein (f) the radial-flow fan is arranged vertically above the heatable material.

* * * * *